United States Patent [19]

Opaskar et al.

[11] 4,440,608

[45] Apr. 3, 1984

[54] PROCESS AND BATH FOR THE ELECTRODEPOSITION OF TIN-LEAD ALLOYS

[75] Inventors: Vincent C. Opaskar, Cleveland Heights; Sidney C. Beach, Parma; Robert J. Zellner, Shaker Heights, all of Ohio

[73] Assignee: McGean-Rohco, Inc., Cleveland, Ohio

[21] Appl. No.: 408,238

[22] Filed: Aug. 16, 1982

[51] Int. Cl.[3] ..... C25D 3/56; C25D 3/60

[52] U.S. Cl. ..... 204/43 S

[58] Field of Search ..... 204/43 S, 123; 106/1.22

[56] References Cited

U.S. PATENT DOCUMENTS 4,053,372 10/1977 Davis ..... 204/43 S 4,194,913 3/1980 Davis ..... 106/1.22

*Primary Examiner*—G. L. Kaplan

*Attorney, Agent, or Firm*—Fay & Sharpe

[57] ABSTRACT

A process is provided for the electrodeposition of alloys of tin and lead by passing electrical current through an anode, an aqueous acidic plating solution and a cathode, wherein the aqueous acidic plating bath includes at least one organic compound having a formula

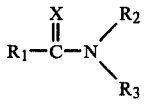

wherein X=O, S, or NH and $R_2$ and $R_3$ are H, or lower alkyl and $R_1$ is

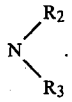

12 Claims, No Drawings

PROCESS AND BATH FOR THE ELECTRODEPOSITION OF TIN-LEAD ALLOYS

BACKGROUND OF THE INVENTION

This invention relates to a bath suitable for the electrodeposition of tin-lead alloys on copper, brass, other copper alloys and steel substrates. This invention also includes methods of accomplishing the deposition of tin-lead alloys by electroplating. This invention, though not specifically so limited, finds particular usefulness in forming a protective and solderable layer over circuitry elements in electronic devices, especially printed circuit boards.

Tin-lead alloys are electrolytically deposited in thicknesses typically ranging from about 0.2 to about 2.0 mils when used in printed and other circuitry to provide a solderable finish, a contact material, or an etchant resistant. Tin can be readily deposited from acidic solutions at room temperature and when a lower melting point material is required, tin-lead alloys, such as the typical 60%–40% solder can also be deposited.

It is common practice in tin-lead plating to use refined peptone as an additive. Even though its performance as a grain refiner is adequate, it suffers from decomposition in the bath and gives off offensive odors. The breakdown products tend to compound the odor problems. Frequent carbon treatment is necessary to control the bath performance. Excessive levels of the additive or its decomposition products in the bath can also cause out-gassing during reflow due to their inclusion in the deposit during the plating cycle.

Although there is economic advantage in operating at higher current densities, peptone baths are conventionally operated at 20 ASF (amperes per square foot) in order to achieve the proper ratio of tin to lead in the plated alloy.

It is an object of this invention to provide an improved process for plating eutectic alloy of tin/lead (63%/37%) particularly suitable for improved reflow characteristics in the printed circuit industry.

Additional objects of this invention are to provide an improved process for plating an alloy of 93% lead and 7% tin for use on bearing surfaces. Also, a process for plating an alloy of 90% tin and 10% lead for use on electrical contacts.

It is a further object of this invention to provide a process to (1) eliminate the need for frequent carbon treatments, (2) eliminate the offensive odors generally associated with peptone baths, (3) provide an additive system that allows extension of the current density range and still retains the desired physical properties and alloy composition, (4) provide improved coverage in low current density areas so that a more uniform thickness ratio is obtained, (5) minimize out-gassing reflow problems by employing a combination of relatively active and stable materials that do not produce undesirable decomposition products, (6) provide smooth nodular free deposits in high current density areas and particularly within printed circuit board holes, (7) provide a process that gives dense, fine grained deposits over a variety of substrates

DESCRIPTION OF THE INVENTION

The above and other objects of the invention are achieved through the provision of plating baths which include the below listed ingredients in the following ranges:

(1)
Fluoboric Acid: 100–600 g/l
preferred: 200–325 g/l (2)
Stannous Fluoborate—(as tin ion): 10–80 g/l
preferred: 15–30 g/l (3)
Lead Fluoborate—(as lead ion): 5-25 g/l
preferred: 10–20 g/l (4)
Boric Acid: 10–15 g/l
preferred: 12 g/l Baths within the above composition ranges are useful chiefly in the printed circuit industry because lower metal concentrations promote an increase in throwing power sufficient to deposit adequate metal in holes through the boards.

Another ingredient employed in the bath used in tin-lead alloy deposition is an ethoxylated alkyl substituted phenol non-ionic wetting agent having the formula:

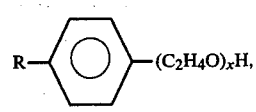

where x=8 to 30; and

R is a $C_8$ or $C_9$ linear aliphatic chain.

The amount of non-ionic wetting agent added to the bath may range from 0.05 to 10 g/l; a preferred range is from 0.1 g/l to 1.0 g/l and a most preferred range is 0.2 g/l to 0.5 g/l.

A typical non-ionic wetting agent according to this formula is Igepal CO-630, made by GAF Corporation. This material has a marked effect on reducing burning and roughness in current density areas above 60 ASF because of its ability to lower the solution surface tension and prevent any liberated hydrogen gas from adhering to the surface. In this regard, a desirable surface tension is 40 dynes/cm.

Nodular or rough deposits are common on plated areas which have sharp discontinuities such as the holes and we have discovered that this problem can be eliminated by the addition of small amounts of a urea compound, or mixtures thereof, according to the formula:

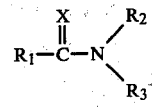

where

X=0, S, or NH and $R_2$ and $R_3$ are H, or lower alkyl and

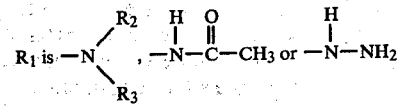

Lower alkyl is limited to moieties up to $C_4$; with ethyl and methyl being preferred.

Specific compounds within this definition which, with a wetting agent of the preferred class, produce smooth, white and fine grained deposits are:

(1) Thiourea

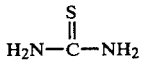

(2) Tetramethyl thiourea

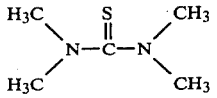

(3) 1,3-diethyl thiourea

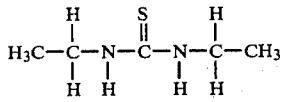

(4) Methyl thiourea

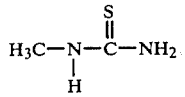

(5) Thioacetamide

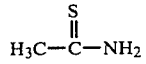

(6) Acetyl thiourea

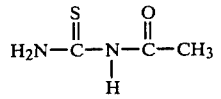

(7) Thio semicarbizide

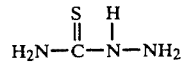

(8) Urea

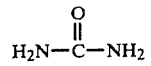

(9) Guanidine

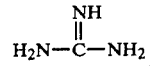

The above grain refining agents, or combinations thereof, are effective from about 0.025 to about 5 g/l. Excellent results are obtained at about 1.0 g/l. When these materials are absent from the bath nodular deposits generally occur at any crystal seed site, such as dirt on the plating surface, exposed fiberglass fibers in drilled holes, etc. The presence of 0.1 g/l of thiourea, for example, gives nodular free deposits up to 45 ASF and at 1.0 g/l, this area is extended to 90 ASF. In addition to this capability, the general grain structure of the entire deposit is finer and appears whiter.

The advantages of this invention are apparent from the following examples.

EXAMPLE 1

An aqueous plating bath for producing Sn/Pb was prepared by mixing 66 ml of 51% stannous fluoborate, 29 ml of 51% lead fluoborate, 372 ml of 49% fluoboric acid, 15 g of boric acid and making the volume up to one liter to provide 21.5 g/l of stannous ion, 12.5 g/l of lead ion, 250 g/l of free fluoboric acid and 15 g/l of boric acid in the bath.

This material was then put into a 1 liter Hull Cell. An anode of 60/40 tin/lead was placed in a 1 liter Hull Cell, such as that described in the Metal Finishing Guidebook & Directory, 1981, on page 404. A sheet of G-10 copper clad fiberglass material (printed circuit board stock) with electrolyte copper plated-thru-holes was used as the cathode in the Hull Cell. The bath was agitated by means of a mechanical stirring arm. The temperature of the bath was maintained at 22° C. After a 10% fluoboric acid dip, the panel was plated at 3 amps for 3 minutes.

The deposit was unsatisfactory. It was black, rough and spongy from the high current density edge (100 ASF) down to 18 ASF and white to 3 ASF. There was no deposit from 3 to 0 ASF.

EXAMPLE 2

A bath was prepared as in Example 1, but with the addition of 0.2 g/l of Igepal CO 630. An appropriate size copper clad fiberglass printed circuit board was plated at 3 amps for 3 minutes.

The overall appearance of the panel was much improved when compared with that plated without the wetting agent as in Example 1. However, the panel had several nodular deposits, known as trees to those familiar with the art, on the face of the panel and through most of the holes in the higher current density areas, i.e., greater than 35 ASF. There was either a lack of or a thin deposit in the area below 6 ASF.

EXAMPLE 3

To the bath from Example 2 was added 1.0 g/l of thiourea.

A copper clad printed circuit board was plated at 3 amps for 3 minutes. The deposit was white matte, fine-grained, smooth and free from nodular deposits (trees) in the current density range from 0 to 100 ASF. The surface to hole ratio deposit thickness was 1:1. An atomic absorption analysis of the deposited alloy showed a tin content of 60%±3% at 15 to 60 ASF.

EXAMPLE 4

With all the conditions from Example 3 the same, panels of brass and mild steel were plated for 3 minutes at 3 amps after the appropriate electrolytic cleaning, rinsing and 10% fluoboric acid dip cycles.

The deposits were white, fine-grained, and free from trees in the current density range of 0 to 100 ASF. The alloy was analyzed to be 60%±3% lead from 15 to 60 ASF.

EXAMPLES 5-12

Baths were made as in Example 2, i.e., basic ingredients for 60/40 tin/lead deposit plus Igepal CO-630. The compounds listed below were added in the concentrations recited to produce smooth white and fine-grained deposits free from nodular or dendritic growths at the current density ranges shown:

| Example No. | Compound | Concentration (g/l) | Range (ASF) |
|---|---|---|---|
| 5 | Tetramethyl thiourea | .02–1.0 | 0–80 |
| 6 | 1,3-diethyl thiourea | 0.06–2.0 | 0–90 |
| 7 | Methyl thiourea | .1–2.0 | 0–80 |
| 8 | Thioacetamide | 0.04–1.0 | 0–75 |
| 9 | Acetyl thiourea | 0.06–2.0 | 2–90 |
| 10 | Thiosemicarbizide | .025–0.5 | 0–50 |
| 11 | Urea | 0.1–2.0 | 0–80 |
| 12 | Guanidine | 0.004–0.12 | 0–80 |

EXAMPLE 13

An aqueous bath for plating a 90% Sn/10 % Pb alloy was prepared by mixing 91 ml of 51% stannous fluoborate, 10 ml of lead fluoborate, 256 ml of fluoboric acid, 10 g boric acid and making the volume up to one liter to provide 30 g/l of stannous ion, 3.6 g/l lead ion, 200 g/l free fluoboric acid and 10 g/l boric acid in the bath.

The additive system to the above bath consisted of 0.1 g/l Igepal CO-630 and 1.0 g/l thiourea. Three substrates were plated in a 1 liter Hull Cell with mechanical agitation for 3 minutes at 3 amps. The deposited metals were white, matte, fine-grained and smooth. The current density range for the various substrates was as follows:

Copper clad printed circuit stock: 0 to 30 ASF
Mild steel panel: 0 to 36ASF
Brass panel: 0 to 60 ASF The tin content from 15 ASF to the high edge of smooth plating was 90±1% for all three substrates.

EXAMPLE 14

An aqueous bath for plating 90% Pb/10% Sn was prepared by mixing 120 ml of 49% $Pb(BF_4)_2$, 10 ml 49% $Sn(BF_4)_2$, 256 ml of 51% $HBF_4$, 10 g boric acid and making the volume up to 1 liter to provide a solution with 44 g/l lead ion, 3 g/l stannous ion, 200 g/l free fluoboric acid, and 10 g/l boric acid in the bath.

The bath was agitated by a mechanical stirring arm and maintained at a temperature of 22° C.. A 90/10 lead/tin anode was placed in a 1 liter Hull Cell as in Example 1. When cleaned and 10% fluoboric acid dipped, mild steel, copper and brass substrates were plated in the above bath for 3 minutes at 3 amps. In all cases coverage from 0 to about 12 ASF was either very thin or totally devoid of deposit. In all cases, the panels were spongy, black and rough from the high current density edge to about 45 ASF. From 45 ASF to 12 ASF the deposits were smooth and white.

EXAMPLE 15

To the bath of Example 13 was added 0.1 g/l of

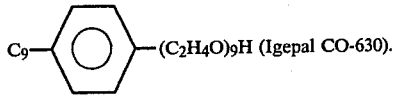

The smooth white plating range was extended on mild steel, copper and brass substrates from 12 ASF to 0 ASF.

EXAMPLE 16

To the bath from Example 15 was added 1.0 g/l thiourea. The smooth white plating range was raised from 45 ASF to 60 ASF on mild steel, copper and brass substrates. Furthermore, the color of the alloy appears lighter than those of Example 15 due to the finer grain structure of the deposit.

EXAMPLE 17

A bath was prepared and run similar to the bath in Example 3, except that the Igepal CO-630 was replaced by an equivalent amount of

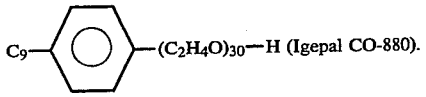

The plating results were the same as in Example 3.

EXAMPLE 18

A bath was prepared and run similar to the bath in Example 3, except that the Igepal CO-630 is replaced by an equivalent amount of

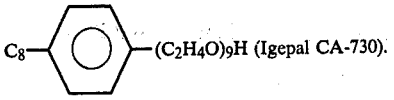

The plating results were the same as in Example 3.

While there have been described what are at present considered to be the preferred embodiments of this invention, it will be apparent to those skilled in the art that various changes and modifications may be made therein without departing from the invention, and it is, therefore, aimed in the appended claims to cover all such changes and modifications as fall within the true spirit and scope of the invention.

What is claimed is:

1. In the process of electrodepositing alloys of tin and lead on a substrate by passing electrical current through an anode, an aqueous acidic fluoride containing plating solution and a cathode, the improvement which comprises including in the aqueous acidic plating bath from about 0.025 to about 5.0 g/l of at least one organic compound having the formula

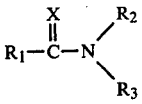

wherein X is O, S, or NH and $R_2$ and $R_3$ are H, or lower alkyl and $R_1$ is

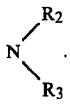

2. The process of claim 1 in which $R_2$ and $R_3$ are individually either ethyl, methyl or hydrogen.

3. The process of claim 2 wherein said bath also includes an ethoxylated alkyl substituted phenol.

4. The process of claim 2 in which the ethoxylated alkyl substituted phenol is present in an amount from about 0.005 to 10 g/l.

5. The process of claim 1 in which the organic compound is thiourea.

6. The process of claim 1 in which the acidic aqueous plating solution contains from about 10 to about 80 g/l of tin as fluoborate, from about 5 to about 25 g/l of lead as fluoborate, from about 100 to about 600 g/l of fluoboric acid, an ethoxylated alkyl substituted phenol in an amount ranging from about 0.1 to about 6 g/l and a urea compound in an amount ranging from about 0.025 to about 5 g/l.

7. A bath for the electrodeposition of alloys of tin and lead comprising an aqueous acidic fluoride containing lead-tin plating solution having dissolved therein from about 0.025 to about 5.0 g/l of at least one compound having the formula

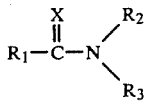

wherein X is O, S, or NH and $R_2$ and $R_3$ are H, or lower alkyl and $R_1$ is

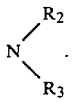

8. The bath of claim 7 in which $R_2$ and $R_3$ are individually either ethyl, methyl or hydrogen.

9. The bath of claim 7 which also contains an ethoxylated alkyl substituted phenol.

10. The bath of claim 9 in which the ethoxylated aliphatic substituted phenol is present in an amount ranging from about 0.005 to about 10 g/l.

11. The bath of claim 7 in which the organic compound is thiourea.

12. The bath of claim 7 in which the acidic aqueous plating solution contains from about 10 to about 80 g/l of tin as fluoborate, from about 5 to about 25 g/l of lead as fluoborate and from about 100 to about 600 g/l of fluoboric acid, an ethoxylated alkyl substituted phenol in an amount ranging from about 0.1 to about 6 g/l, and a urea compound in an amount ranging from about 0.025 to about 5 g/l.

* * * * *